US010612423B2

(12) United States Patent
Ohman

(10) Patent No.: US 10,612,423 B2
(45) Date of Patent: Apr. 7, 2020

(54) ORC FOR TRANSPORTING WASTE HEAT FROM A HEAT SOURCE INTO MECHANICAL ENERGY AND COOLING SYSTEM MAKING USE OF SUCH AN ORC

(71) Applicant: ATLAS COPCO AIRPOWER, NAAMLOZE VENNOOTSCHAP, Wilrijk (BE)

(72) Inventor: Henrik Ohman, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 15/757,350

(22) PCT Filed: Aug. 18, 2016

(86) PCT No.: PCT/BE2016/000040
§ 371 (c)(1),
(2) Date: Mar. 3, 2018

(87) PCT Pub. No.: WO2017/041147
PCT Pub. Date: Mar. 16, 2017

(65) Prior Publication Data

US 2018/0252120 A1 Sep. 6, 2018

Related U.S. Application Data

(60) Provisional application No. 62/215,249, filed on Sep. 8, 2015.

(30) Foreign Application Priority Data

Aug. 17, 2016 (BE) ..... 2016/5642

(51) Int. Cl.
*F01K 11/00* (2006.01)
*F01K 21/00* (2006.01)
(Continued)

(52) U.S. Cl.
CPC ..... *F01K 11/00* (2013.01); *F01K 21/005* (2013.01); *F01K 25/04* (2013.01); *F01K 25/08* (2013.01); *F01K 9/003* (2013.01); *F01K 25/14* (2013.01)

(58) Field of Classification Search
CPC ..... F01K 11/00; F01K 25/04; F01K 21/005; F01K 25/08; F01K 25/14; F01K 9/003
(Continued)

(56) References Cited

U.S. PATENT DOCUMENTS 3,686,867 A * 8/1972 Hull ..... F01K 19/08 60/667
3,747,333 A * 7/1973 Gerstmann ..... F01K 13/006 137/341
(Continued)

FOREIGN PATENT DOCUMENTS

EP 1930558 A1 6/2008
EP 2865854 A1 4/2015
(Continued)

OTHER PUBLICATIONS

International Search Report dated Feb. 17, 2017 on PCT/BE2016/000040.

*Primary Examiner* — Hoang M Nguyen
(74) *Attorney, Agent, or Firm* — Bacon & Thomas, PLLC

(57) ABSTRACT

An Organic Rankine Cycle (ORC) device and method for transforming heat from a heat source into mechanical energy. The ORC includes a closed circuit containing a two phase working fluid. The circuit comprises a liquid pump for circulating the working fluid consecutively through an evaporator which is configured to be placed in thermal contact with the heat source; through an expander for transforming the thermal energy of the working fluid into mechanical energy; and through a condenser which is in thermal contact with a cooling element. The expander is
(Continued)

situated above the evaporator. The fluid outlet of the evaporator is connected to the fluid inlet of the expander by a raiser column which is filled with a mixture of liquid working fluid and of gaseous bubbles of the working fluid, which mixture is supplied to the expander.

17 Claims, 2 Drawing Sheets

(51) Int. Cl.

| | |
|---|---|
| ***F01K 25/04*** | (2006.01) |
| ***F01K 25/08*** | (2006.01) |
| ***F01K 9/00*** | (2006.01) |
| ***F01K 25/14*** | (2006.01) |

(58) Field of Classification Search
USPC ..... 60/649, 671, 646, 657, 661, 666
See application file for complete search history.

(56) References Cited

U.S. PATENT DOCUMENTS

| | | | | |
|---|---|---|---|---|
| 3,938,335 | A | 2/1976 | Marwick | |
| 7,665,304 | B2 * | 2/2010 | Sundel | F01K 15/04 60/671 |
| 8,046,999 | B2 * | 11/2011 | Doty | F01K 3/12 60/646 |
| 8,869,531 | B2 * | 10/2014 | Held | F01K 3/185 60/651 |
| 8,955,323 | B2 | 2/2015 | Kamiya | |
| 9,702,268 | B2 | 7/2017 | Smague et al. | |
| 10,247,046 | B2 | 4/2019 | Schuster et al. | |
| 2009/0249779 | A1 | 10/2009 | Shiao | |
| 2010/0034684 | A1 * | 2/2010 | Ast | F01K 21/005 418/84 |
| 2015/0013338 | A1 | 1/2015 | Smague et al. | |
| 2015/0377080 | A1 * | 12/2015 | Fortini | F01K 25/10 60/657 |

FOREIGN PATENT DOCUMENTS

| | | | |
|---|---|---|---|
| FR | 777778 | A | 2/1935 |
| FR | 1010036 | A | 6/1952 |
| JP | 57148011 | A | 9/1982 |
| JP | H0979504 | A | 3/1997 |
| JP | 2011012659 | A | 1/2011 |
| KR | 20100044737 | A | 4/2010 |
| RU | 27395 | U1 | 1/2003 |
| WO | 2008068491 | A2 | 6/2008 |

* cited by examiner

ORC FOR TRANSPORTING WASTE HEAT FROM A HEAT SOURCE INTO MECHANICAL ENERGY AND COOLING SYSTEM MAKING USE OF SUCH AN ORC

The present invention relates to an ORC for transforming waste heat from a heat source into mechanical energy and to a cooling system making use of such an ORC for cooling a source of waste heat.

BACKGROUND OF THE INVENTION

Power cycles for WTP (Waste heat to Power) are well described, such as ORC, Kalina, Trilateral Flash etc.

Such power cycles are designed to recover waste heat from the heat source and to transform said energy into useful mechanical energy that can be used for instance for driving a generator for generating electrical power.

The use of an ORC (Organic Rankine Cycle) is in particular known to recover waste energy of heat sources with relatively low temperature like the heat of compressed gas produced by a compressor installation, or comprised in exhaust gasses, flue gasses, steam, hot water or the like.

Such known ORC's comprise a closed loop circuit containing a two-phase working fluid, the circuit further comprising a liquid pump for circulating the fluid in the circuit consecutively through an evaporator which is in thermal contact with the heat source to evaporate the working fluid; through an expander like a turbine for transforming the thermal energy transmitted to the gaseous working fluid produced in the evaporator into useful mechanical energy; and finally through a condenser which is in thermal contact with a cooling medium like water or ambient air in order to transform the gaseous working fluid into liquid that can be returned to the evaporator for the next working cycle of the working fluid.

In installations producing hot gasses, the ORC is used for cooling said hot gasses by bringing these hot gasses in contact with the evaporator of the ORC and at the same time to use the ORC for transforming the heat recovered in the evaporator into useful energy in the expander.

A disadvantage of the existing ORC's is that the size of the evaporator has to be relatively large in order to have a sufficient heat transfer contact between the working fluid in the evaporator and the heat source, especially with a low temperature heat source of for example 90° C. or even 60° C., the contact surface between the liquid fraction of the working fluid to be evaporated in the evaporator being only a small fraction of the total contact surface of the evaporator since the evaporator only contains liquid at the bottom and vapors of the working fluid on top of it.

Another disadvantage is that in case of a failure of the liquid pump or expander, the circulation of the working fluid in the ORC comes to a halt automatically, since the evaporator needs to be located above the expander in order to provide a gravitational flow of the liquid fraction of the fluid from the evaporator to the expander, especially when a two-phase fluid to the inlet of the expander is preferred.

When the working fluid in the ORC stops circulating, the cooling function of the ORC to cool the hot gasses is lost, leading to potentially dangerous situations whereby the downstream installations or downstream users making use of the uncooled hot gasses could be damaged due to overheating.

The unpublished Belgian patent application 2014/0654 of the same applicant provides for a solution in case of failure of the liquid pump of the ORC by introducing auxiliary coolers which are not part of the ORC system and which therefore can secure cooling the compressed gasses in case of failure of the ORC system.

A disadvantage is that auxiliary coolers have to be provided.

SUMMARY OF THE INVENTION

It is an objective of the present invention to give a solution to one or more of the above-mentioned and other disadvantages.

Therefore the invention aims an ORC for transforming waste heat from a heat source into mechanical energy, the ORC comprising a closed circuit containing a two-phase working fluid, the circuit comprising a liquid pump for circulating the working fluid in the circuit consecutively through an evaporator which is configured to be placed in thermal contact with said heat source; through an expander for transforming the thermal energy of the working fluid into work; and through a condenser which is in thermal contact with a cooling element, whereby the expander is situated above the evaporator and the fluid outlet of the evaporator is connected to the inlet of the expander by means of a so called raiser column which is filled with a mixture of liquid working fluid and of gaseous bubbles of the working fluid, which mixture is supplied to the expander, and whereby the raiser column extends with at least a part at the same level or above the level of the inlet of the expander in such a way that a gravitational flow is possible of the liquid working fluid supplied by the raiser column to the expander.

By making sure that the raiser column is filled with a mixture of liquid and of gaseous working fluid creates a kind of pumping effect for the two phase working fluid to be supplied to the inlet of the expander and further downstream to the inlet of the condenser by the force of gravity, the condenser preferably being primarily located at the same level or at a lower level than the expander and the evaporator preferably being primarily located at the same level or at a lower level than the condenser in such a way that a gravitational flow is possible of the liquid working fluid supplied by the expander to the condenser and further down from the condenser to the evaporator. An advantage of the pumping effect of the raiser column is that in case of a blocked liquid pump or expander, the working fluid still continues to circulate autonomously in the ORC circuit and the ORC starts functioning as a kind of heat pipe or thermosiphon.

An advantage related to this self circulating effect is that, even in the unfortunate situation of a blocked liquid pump or expander when the ORC is used for cooling the heat source, the ORC continues its cooling function, thereby eliminating the need to have to provide separate cooling devices in addition to the ORC when cooling is critical.

According to a preferred embodiment, the lowest part of the fluid inlet of the condenser is located lower than the lowest part of the rotative, active parts of the expander.

Throughout this text, the expression "rotative, active parts of the expander" refers to those rotative parts of the expander that, in operation, are directly involved in the fluid expansion process, such as the helical rotors in case of a screw expander, the impeller in case of a turbine, the scroll in case of a scroll expander, the piston in case of a piston expander, or the like. The expression "rotative, active parts of the expander", however, excludes non-active parts that are not involved in the expansion process, such as bearings, a generator or the like.

In a similar way it is preferred that the lowest part of the fluid inlet of the evaporator is located lower than the lowest part of the fluid outlet of the condenser.

The ORC is preferably provided with a bypass bridging the inlet and the outlet of the liquid pump and comprising a valve with a control for keeping the valve closed during normal operating conditions of the ORC and opening the valve in case the liquid pump would not be operational due to failure or other reasons.

An advantage is that the bypass can override the flow resistance of a defective liquid pump that could obstruct the gravitational flow of the working fluid and therefore also the cooling effect of the ORC.

Similarly, the ORC is preferably provided with a bypass bridging the inlet and the outlet of the expander and comprising a valve with a control for keeping the valve closed during normal operating conditions of the ORC and opening the valve in case the expander would not be operational due to failure or other reasons.

Another aspect of the invention is that the ORC is so designed that in at least some operating conditions the evaporator is completely filled with boiling working fluid and in that the raiser column is filled with a mixture of liquid working fluid and of gaseous bubbles of the working fluid, which mixture is supplied to the expander.

An advantage of an ORC according to the invention is that the evaporator is filled with boiling liquid working fluid, thereby maximizing the contact surface between the liquid working fluid and the heat source and thereby maximizing the heat transfer with the heat source and thereby maximizing the amount of heat recovered from the heat source to be transformed into mechanical energy by the expander.

In case of an ORC used for cooling the compressed gasses of a compressor installation, this also means maximizing the cooling function of the ORC.

An advantage related to the efficient cooling of the compressed gasses in contact with the evaporator is that no additional cooling is required and that in design a smaller evaporator can be chosen.

The raiser column provides a guarantee that the evaporator internal surfaces are covered all the time by liquid, the liquid in the raiser column tending to flow backwards into the evaporator to replace the gas bubbles produced in the evaporator by boiling of the working fluid.

The present invention also relates to a cooling system for cooling a source of waste heat, whereby the cooling system comprises an ORC according the invention as only means for cooling of the heat source without the need for any additional external cooling, also in conditions of non operation of the expander and/or of the liquid pump.

BRIEF DESCRIPTION OF THE DRAWINGS

With the intention of better showing the characteristics of the invention, hereafter, as an example without any limitative character, some preferred embodiments are described of an ORC according to the invention for transforming waste heat from a heat source into mechanical energy and of a compressor installation making use of such an ORC, with reference to the accompanying drawings, wherein.

DETAILED DESCRIPTION OF THE INVENTION

Figure 1:
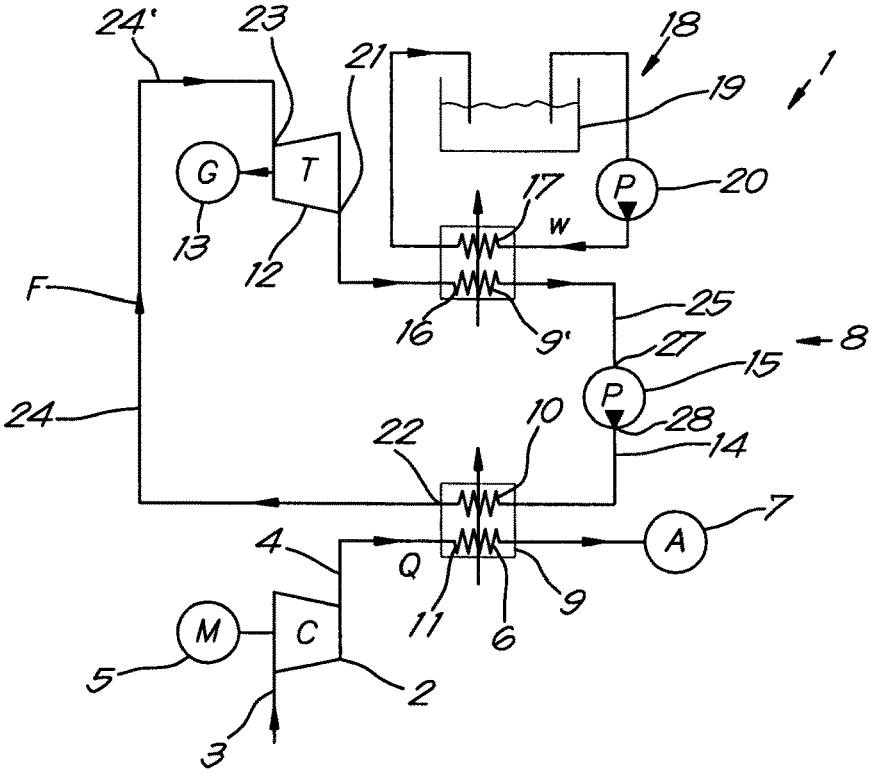
FIG. 1 schematically represents a single stage compressor installation making use of an ORC system according to the invention.

The cooling system 1 represented in FIG. 1 is a cooling system for cooling for example the compressed gas produced by a compressor installation comprising a compressor element 2 with an inlet 3 and an outlet 4, said compressor element 2 being connected to a motor 5 for driving the compressor element 2 for compressing a gas flow Q. Further, the cooling system 1 comprises a cooler 6, which is provided downstream of said compressor element 2, for cooling the compressed gas before it is supplied to a net 7 of consumers of compressed gas.

The cooling installation 1 comprises an ORC 8 according to the invention wherein the above-mentioned cooler 6 is integrated in a heat exchanger 9 which further integrates an evaporator 10 of the ORC 8 for recovering the waste heat of the compressed gas used as a heat source 11 being configured to transform said heat into useful mechanical energy by means of an expander 12 of the ORC 8, for example a turbine driving an electrical generator 13 as shown in the example of FIG. 1.

The ORC comprises a closed circuit 14 containing a two-phase organic working fluid with a boiling temperature below the temperature of the heat source 11, the working fluid being continuously circulated around in the circuit 14 by means of a liquid pump 15 in the direction as indicated with arrows F.

The working fluid is made to flow consecutively through the evaporator 10 which is in thermal contact with the heat source 11; then through the expander 12 and finally through a condenser 16 before being launched again by the liquid pump 15 for a next cycle in the circuit 14.

The condenser 16 is part of a heat exchanger 9' in which the condenser 16 is in thermal contact with a cooling element 17 of a cooling circuit 18 which, in the example of FIG. 1, is represented as a supply of cold water W taken from a tank 19 to circulate through the condenser 16 by means of a pump 20.

According to the invention the condenser 16 is physically located lower than the expander 12, whilst the evaporator 10 is physically located lower than the condenser 16 in such a way that a gravitational flow is possible of the liquid working fluid supplied by the raiser column 24 to the expander 12 and further down from the expander 12 to the condenser 16 and from the condenser 16 to the evaporator 10.

The term "lower than" does not require that all parts of the condenser/evaporator are located lower. It means that the main parts of the condenser/evaporator at a lower level. The term should be understood in the context of a requirement for creating a gravitational flow of the liquid part of the working fluid.

Figure 2:
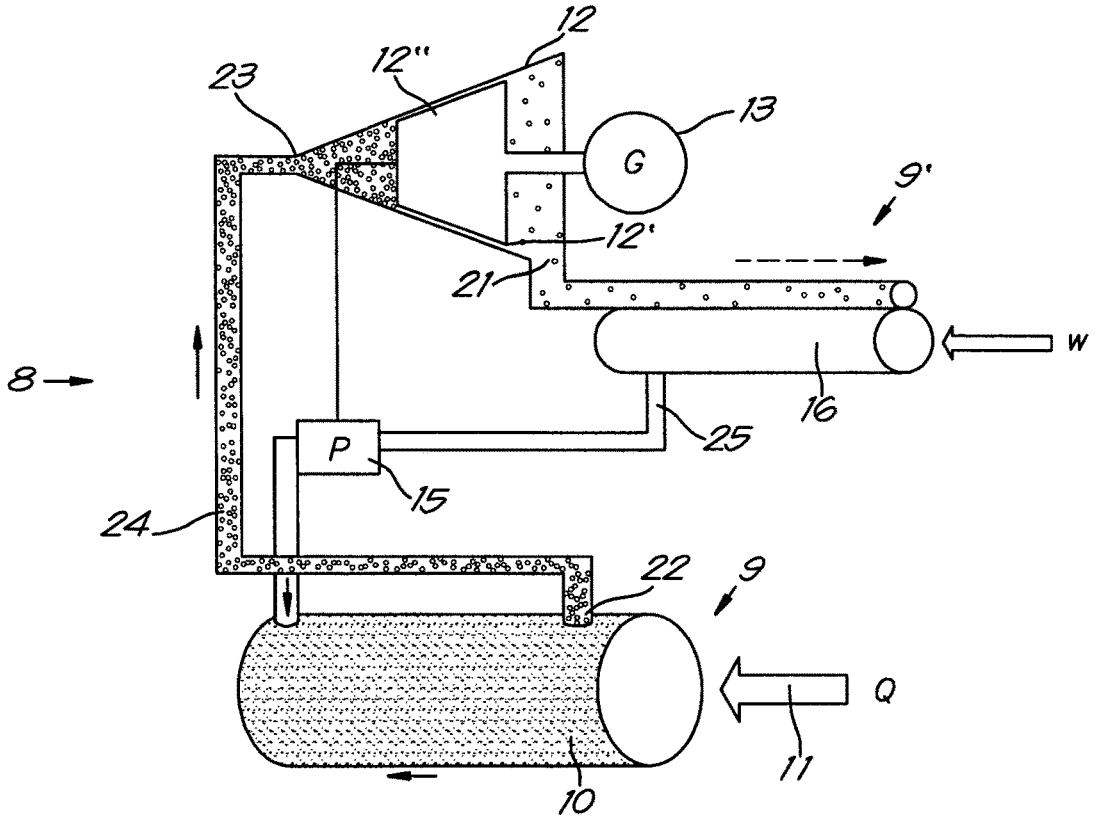
FIG. 2 represents the ORC of FIG. 1 in a more realistic way.

Preferably at least the lowest part of the fluid inlet of the condenser 16 is physically located lower than the lowest part 12' of the rotative, active parts 12" of the expander 12, as schematically represented in FIG. 2, whilst the lowest part of the fluid inlet of the evaporator 10 is physically located lower than the lowest part of the fluid outlet of the condenser 16, the fluid outlet 22 of the evaporator 10 being connected to the fluid inlet 23 of the expander 12 by means of a so called raiser column 24.

The ORC 8 according to the invention is so designed that in normal operating conditions the evaporator 10 is completely filled with boiling working fluid and in that the raiser column is filled over its entire height with a mixture of working fluid in liquid form and of gaseous bubbles of the working fluid, which mixture is supplied to the fluid inlet 23 of the expander 12 through a bended part 24' of the raiser column 24, which bended part 24' extends with at least with a part above the lowest part of the fluid inlet 23 of the expander 12.

The expression "filled with boiling liquid working fluid" means that the gaseous bubbles created by boiling do not accumulate at the top of the evaporator 10, such that the working fluid in the evaporator 10 is not separated in a liquid part and a gaseous part accumulated in a space on top of the liquid part as in known ORC's.

Normal operation of the ORC 8 according to the invention is that the working fluid is made to boil in the evaporator 10 by the heat of the compressed gasses which at the same time are cooled.

The liquid pump 15 is designed to assure that it is pumping more working fluid to the evaporator 10 than can be evaporated by the heat of the compressed gas to be sure that the evaporator is completely filled with boiling liquid for maximum recovery of the heat from the compressed gas.

In the raiser column 24 is a mixture of gas bubbles from the working fluid and of working fluid in liquid form which, as schematically represented in FIG. 2, is transported and supplied to the inlet 23 of the expander 12 which therefore has to be chosen amongst types of expanders which are able to deal with such a two phase mixture.

The bent 24' should be located at the same level or at a higher level than the fluid inlet 23 of the expander in order that the liquid coming with the gas bubbles through the raiser column 24 will flow over the bent 24' and fall downwards by gravity through the expander 12 and to the condenser 16, from where it is supplied again to the evaporator 10 via the conduit 25 of the circuit 14 connecting the condenser 16 with the evaporator 10.

The gas bubbles produced in the evaporator 10 will tend to rise in the raiser column 24 as well as in the conduit 25 but will take the passage of least resistance via the raiser column 24.

As such, a kind of self circulating effect is created by the raiser column 24 which helps to circulate the working fluid in the circuit 14.

Even when the liquid pump 15 or the expander 12 gets blocked, the ORC continues to circulate the working fluid in the circuit 14 assisted by the force of gravity, thereby providing sufficient cooling of the compressed gas in the evaporator 10 to avoid dangerous conditions to arise until the liquid pump 15 or the expander 12 can be fixed.

It is clear that an ORC 8 according to the invention can also be used in other applications than for cooling compressed gas, such as cooling flue gasses, steam, etc.

Cooling of the condenser 16 can be realized in other ways than in the example of FIG. 1, for example by blowing ambient air over the condenser 16 by means of a fan or the like.

The expander 12 can be any kind of expander capable of generating mechanical energy by expansion of a two phase fluid supply, preferably a volumetric expander like a screw expander or a mechanical cylinder or the like which can accept a mixture of liquid and gaseous working fluid.

Preferably a working fluid is used of which the boiling temperature is lower than 90° C. or even lower than 60° C., depending on the temperature of the available heat source 11.

An example of a suitable organic working fluid is 1,1,1,3,3-pentafluoroprophane. The organic fluid could be mixed with a suitable lubricant for the lubrication of at least part of the moving parts of the ORC.

Summarized, the raiser column 24 should be designed with appropriate dimensions to accommodate the following effects:

- ensure that the evaporator surfaces are always in contact with liquid;
- create a desirable pressure difference between evaporator and expander inlet;
- create a suitable difference of elevation between expander and condenser;
- allow a suitable difference of elevation between condenser and liquid pump;
- ensure that the WTP-system operates as a heat pipe/thermo siphon when expander and/or liquid pump is non-operable.

It has to be understood that, when evaluating prior art documents in the field of ORC, the relative locations of the constituting components in the schematics of the ORC's do not necessarily correspond to the relative physical locations of said components.

Figure 3:
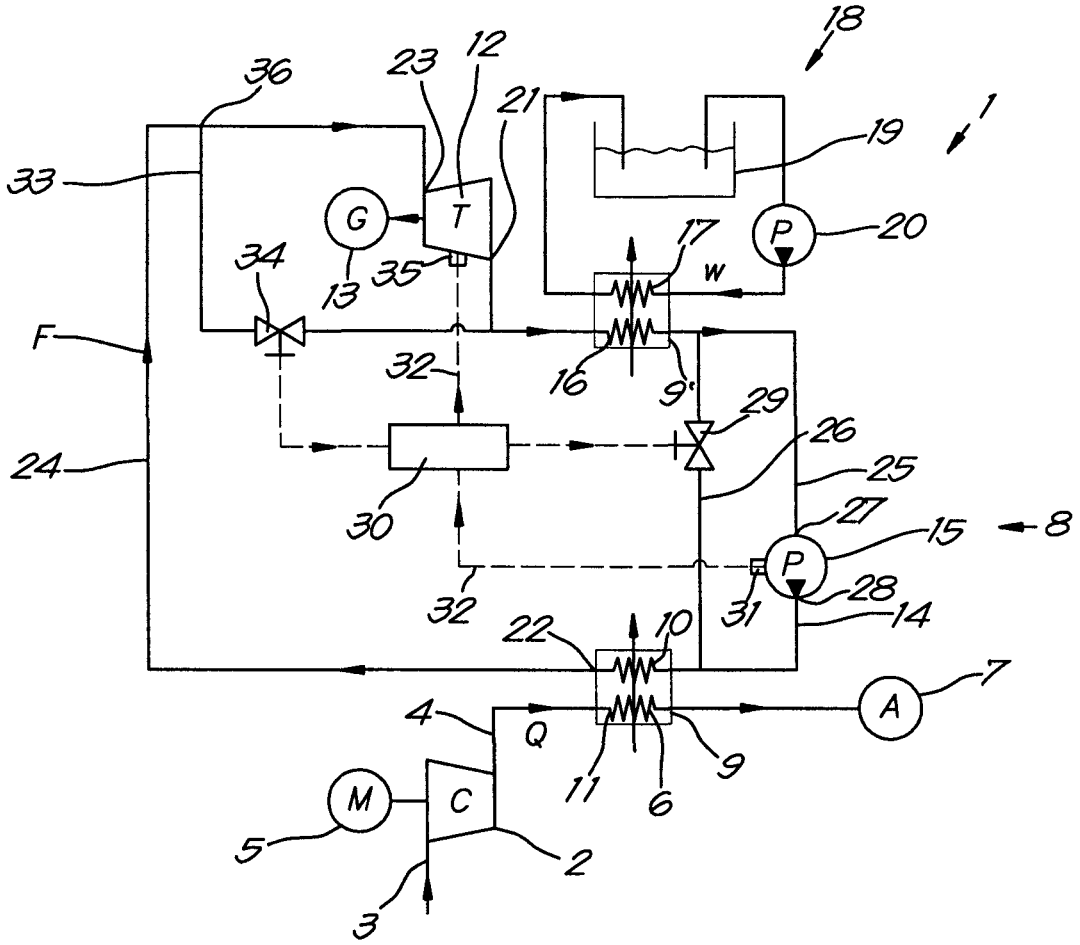
FIG. 3 represents an alternative embodiment of the compressor installation of FIG. 1.

In FIG. 3 an alternative embodiment is shown of a cooling installation according to the invention which differs from the embodiment of FIG. 1 in that the ORC circuit is provided with a bypass 26 bridging the inlet 27 and the outlet 28 of the liquid pump 15.

Said bypass 26 comprising a valve 29 connected to a control 30 for keeping the valve 29 closed during normal operating conditions of the ORC 8 and opening the valve 29 in case the liquid pump 15 would not be operational due to failure or other reasons. The control 30 is therefore coupled to a sensor 31 by means of an electric harness 32 for sensing when the liquid pump 15 is not operational.

Similarly the ORC of FIG. 3 is provided with a bypass 33 bridging the inlet 23 and the outlet 21 of the expander 12 and comprising a valve 34 connected via the harness 32 to the control 30 for keeping the valve 34 closed during normal operating conditions of the ORC 8 and opening the valve 34 in case the input signal coming from a sensor 35 on the expander 12 would indicate that the expander 12 is not operational.

The control 30 can either open only one of the bypass valves 29 or 34 depending on which of the liquid pump 15 and expander 12 would not be operational or can open both valves 29 and 34 simultaneously.

The location 36 where the bypass 34 branches to the ORC circuit 14 at the inlet side of the expander 12 would preferably need to be situated at a higher level than the condenser 16.

The present invention is in no way limited to the form of embodiments described by way of an example and represented in the figures, however, such an ORC according to the invention for transforming waste heat from a heat source into mechanical energy and of a compressor installation making use of such an ORC can be realized in various forms without leaving the scope of the invention.

The invention claimed is:

1. An Organic Rankine Cycle (ORC) installation for transforming heat from a heat source into mechanical energy, the ORC installation comprising:

- a closed circuit containing a two-phase working fluid, the closed circuit comprising a liquid pump for circulating the two-phase working fluid in the closed circuit consecutively through an evaporator which is configured to be placed in thermal contact with said heat source;

through an expander for transforming thermal energy of the two-phase working fluid into mechanical energy; and through a condenser which is in thermal contact with a cooling element, wherein the expander is physically located above the evaporator and a fluid outlet of the evaporator is connected to a fluid inlet of the expander by a raiser column which is filled with a mixture of liquid working fluid and of gaseous bubbles of the working fluid in a way such that the liquid working fluid flows into the evaporator to replace the gaseous bubbles of the working fluid produced in the evaporator, said mixture being supplied to the expander, and in that the raiser column extends with at least a part at a same level or above a level of the fluid inlet of the expander in such a way that a gravitational flow of the liquid working fluid is used to supply at least some of the working fluid from the raiser column to the expander, wherein the condenser is primarily located at a lower level than the expander in such a way that a gravitational flow of the liquid working fluid is used to supply the working fluid from the expander to the condenser, wherein the evaporator is primarily located at a lower level than the condenser in such a way that a gravitational flow of the liquid working fluid is used to supply the working fluid from the condenser to the evaporator, and wherein the ORC installation is designed such that, in case the expander and/or the liquid pump are not operational, the ORC installation operates as a self circulating circuit, driven by thermal gravitational effects on the fluid.

2. The ORC installation according to claim 1, wherein a lowest part of the fluid inlet of the condenser is located lower than a lowest part of the rotative, active parts of the expander.

3. The ORC installation according to claim 1, wherein a lowest part of the fluid inlet of the evaporator is located lower than lowest part of the fluid outlet of the condenser.

4. The ORC installation according to claim 1, wherein the ORC installation is so designed that in at least some operating conditions the evaporator is completely filled with boiling working fluid and in that the raiser column is filled with a mixture of liquid working fluid and of gaseous bubbles of the working fluid, which mixture is supplied to the expander.

5. The ORC installation according to claim 4, wherein a capacity of the liquid pump is chosen such that said liquid pump is pumping more liquid than could be evaporated in the evaporator.

6. The ORC installation according to claim 1, wherein the ORC circuit is provided with a bypass bridging the inlet and the outlet of the liquid pump and comprising a valve with a control for keeping the valve closed during normal operating conditions of the ORC installation and opening the valve in case the liquid pump would not be operational due to failure or other reasons.

7. The ORC installation according to claim 1, wherein the ORC circuit is provided with a bypass bridging the inlet and the outlet of the expander and comprising a valve with a control for keeping the valve closed during normal operating conditions of the ORC installation and opening the valve in case the expander would not be operational due to failure or other reasons.

8. The ORC installation according to claim 4, wherein the control of the valves is such that in case the expander and/or the liquid pump fails, both valves are opened.

9. The ORC installation according to claim 1, wherein the expander is of any kind suitable to accept a mixture of liquid and gaseous working fluid.

10. The ORC installation according to claim 1, wherein the expander is a volumetric expander.

11. The ORC installation according to claim 1, wherein the expander is a screw expander.

12. The ORC installation according to claim 1, wherein a working fluid is used which comprises a lubricant or which acts as a lubricant.

13. The ORC installation according to claim 1, wherein a working fluid is used of which the boiling temperature is lower than 90° C.

14. The ORC installation according to claim 7, wherein a location where the bypass branches to the ORC circuit at the inlet side of the expander is situated at a higher level than the condenser.

15. A cooling system for cooling a source of waste heat, wherein the cooling system comprises an ORC installation according to claim 1 as only means for cooling of the heat source without the need for any additional external cooling, also in conditions of non operation of the expander and/or of non-operation of the liquid pump.

16. The ORC installation according to claim 13, wherein a working fluid is used of which the boiling temperature is lower than 60° C.

17. An Organic Rankine Cycle (ORC) installation for transforming heat from a heat source into mechanical energy, the ORC installation comprising:

a closed circuit containing a two-phase working fluid, the closed circuit comprising a liquid pump for circulating the two-phase working fluid in the closed circuit consecutively through an evaporator which is configured to be placed in thermal contact with said heat source; through an expander for transforming thermal energy of the two-phase working fluid into mechanical energy; and through a condenser which is in thermal contact with a cooling element, wherein a fluid outlet of the evaporator is connected to a fluid inlet of the expander by a raiser column which is filled with a mixture of liquid working fluid and of gaseous bubbles of the working fluid, and where in the installation is configured so that the liquid working fluid flows into the evaporator to replace the gaseous bubbles of the working fluid produced in the evaporator, said mixture being supplied to the expander, and in that the raiser column extends with at least a part at a same level or above a level of the fluid inlet of the expander in such a way that a gravitational flow of the liquid working fluid is used to supply at least some of the working fluid from the raiser column to the expander, wherein the condenser is primarily located at a lower level than the expander in such a way that a gravitational flow of the liquid working fluid is used to supply the working fluid from the expander to the condenser, wherein the evaporator is primarily located at a lower level than the condenser in such a way that a gravitational flow of the liquid working fluid is used to supply the working fluid from the condenser to the evaporator, and wherein the ORC installation is designed such that, in case the expander and/or the liquid pump are not operational, the ORC installation operates as a self circulating circuit, driven by thermal gravitational effects on the fluid.

* * * * *